US010184274B1

(12) United States Patent
Schneider et al.

(10) Patent No.: US 10,184,274 B1
(45) Date of Patent: Jan. 22, 2019

(54) ADJUSTABLE CLAMP PRODUCT SECURITY DEVICE

(71) Applicants: Peter Schneider, Neckargemund (DE); Anthony F. Piccoli, West Deptford, NJ (US)

(72) Inventors: Peter Schneider, Neckargemund (DE); Anthony F. Piccoli, West Deptford, NJ (US)

(73) Assignee: CHECKPOINT SYSTEMS, INC., Thorofare, NJ (US)

( * ) Notice: Subject to any disclaimer, the term of this patent is extended or adjusted under 35 U.S.C. 154(b) by 0 days.

(21) Appl. No.: 15/648,114

(22) Filed: Jul. 12, 2017

(51) Int. Cl.
*E05B 73/00* (2006.01)

(52) U.S. Cl.
CPC ..... *E05B 73/0017* (2013.01); *E05B 73/0058* (2013.01)

(58) Field of Classification Search
CPC ..... E05B 73/0017; E05B 73/0058; E05B 73/0023; E05B 73/0052; E05B 67/383; E05B 73/00; E05B 73/0005; E05B 67/003; B60R 25/093
USPC ..... 70/30, 49, 14, 18, 19, 57.1, 58; 340/572.9
See application file for complete search history.

(56) References Cited

U.S. PATENT DOCUMENTS 1,462,238 A * 7/1923 Mennillo ..... E05B 67/003 70/15
2,190,661 A * 2/1940 Hauer ..... E05B 67/003 24/132 R
3,907,255 A * 9/1975 McElroy ..... B66B 5/24 188/188
4,646,452 A * 3/1987 Mazzucchelli ..... E05B 73/0017 40/666
4,730,087 A * 3/1988 Werner ..... H01R 4/5033 174/94 R
5,119,652 A * 6/1992 Costa ..... G08B 13/2422 292/307 R
5,144,820 A * 9/1992 Holmgren ..... E05B 73/0035 351/111
6,374,647 B1 * 4/2002 Holmgren ..... E05B 73/0017 70/57.1
6,629,440 B1 * 10/2003 Meekma ..... A63C 11/006 70/14
6,755,055 B2 * 6/2004 Sedon ..... E05B 73/0017 292/319
7,266,979 B2 * 9/2007 Belden, Jr. ..... E05B 73/0041 206/1.5
8,179,267 B2 * 5/2012 Anderson ..... E05B 73/0017 190/120
8,978,427 B2 * 3/2015 Ho ..... E05B 73/0017 70/14

* cited by examiner

*Primary Examiner* — Suzanne L Barrett
(74) *Attorney, Agent, or Firm* — McDonald Hopkins LLC

(57) ABSTRACT

An example security device is provided that includes a core and a shuttle. The core includes an internal jaw and a guide surface and a distance between the internal jaw and the guide surface varies across a length of the core. The shuttle includes an opening that forms an external jaw. A jaw gap is defined between the internal jaw and the external jaw that is configured to receive a portion of an item to protect.

18 Claims, 5 Drawing Sheets

ADJUSTABLE CLAMP PRODUCT SECURITY DEVICE

TECHNICAL FIELD

Example embodiments generally relate to security technology, and more particularly, relate to a security device for use in retail loss prevention.

BACKGROUND

Product security devices are commonly used in a number of settings, including in retail loss prevention. In this regard, retail theft prevention systems, often referred to as electronic article surveillance (EAS) systems, use antennas located at the exits of a retail establishment to detect RF signals emitted by a security device that is affixed to items for sale. A product security device may be affixed or locked to a product, and if the device is not removed at a point-of-sale during a sales transaction, the security device will be detected by the EAS system as the device, which is affixed to an item, leaves the store. An alarm may be triggered because the removal of the device from the retail establishment is likely to be associated with an attempted theft.

SUMMARY OF SOME EXAMPLES

According to some example embodiments, a security device is provided. The security device may comprise a core comprising an internal jaw and a guide surface. A distance between the internal jaw and the guide surface may vary across a length of the core. The security device may further comprise a shuttle comprising an opening that forms an external jaw. The core may be movably disposed within the opening of the shuttle such that the guide surface engages with the shuttle. A jaw gap may be defined between the internal jaw and the external jaw. The guide surface may be positioned to guide movement of the shuttle such that as the shuttle moves relative to the core in a sliding direction that includes a horizontal component. The variation in the distance between internal jaw and the guide surface may cause the jaw gap to change in a vertical direction. The jaw gap may be configured to receive a portion of an item to protect.

Another example embodiment is a system comprising a detacher key and a security device. The detacher key may comprise a magnet. The security device may comprise a core comprising an internal jaw and a guide surface. A distance between the internal jaw and the guide surface may vary across a length of the core. The security device may further comprise a shuttle comprising an opening that forms an external jaw. The core may be movably disposed within the opening of the shuttle such that the guide surface engages with the shuttle. A jaw gap may be defined between the internal jaw and the external jaw. The guide surface may be positioned to guide movement of the shuttle such that as the shuttle moves relative to the core in a sliding direction having a horizontal component. The variation in the distance between internal jaw and the guide surface may cause the jaw gap to change in a vertical direction. The jaw gap may be configured to receive a portion of an item to protect. The core may further comprise ratcheting teeth and the shuttle may further comprise a spring biased member configured to engage the ratcheting teeth. The spring biased member may be configured to be compressed and moved out of engagement with the ratcheting teeth in response to a magnetic field thereby allowing the shuttle to slide freely in a forward sliding direction and a rearward sliding direction. The magnet of the detacher key may provide the magnetic field.

BRIEF DESCRIPTION OF THE DRAWINGS

Figure 1:
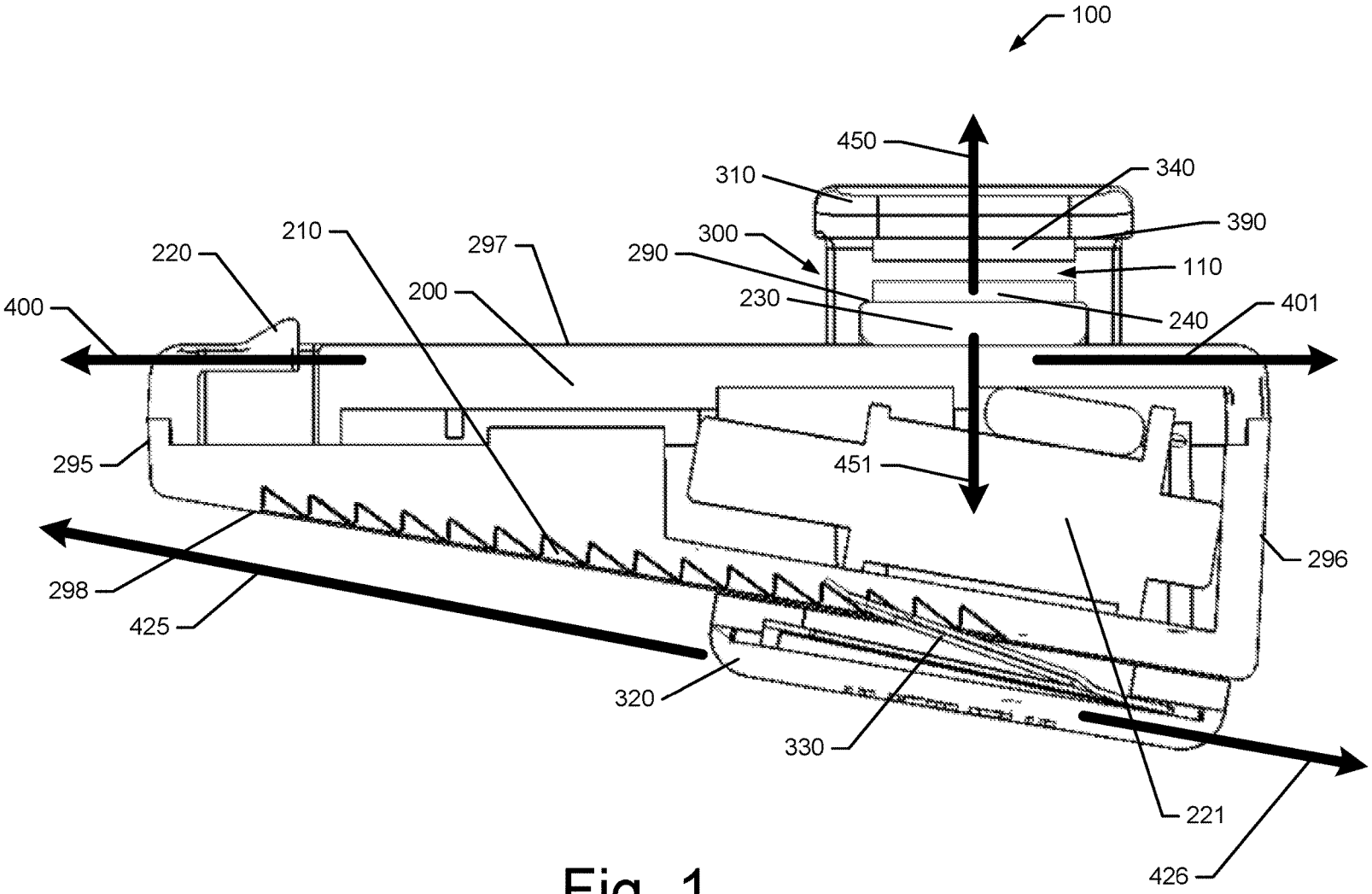
Figure 2:
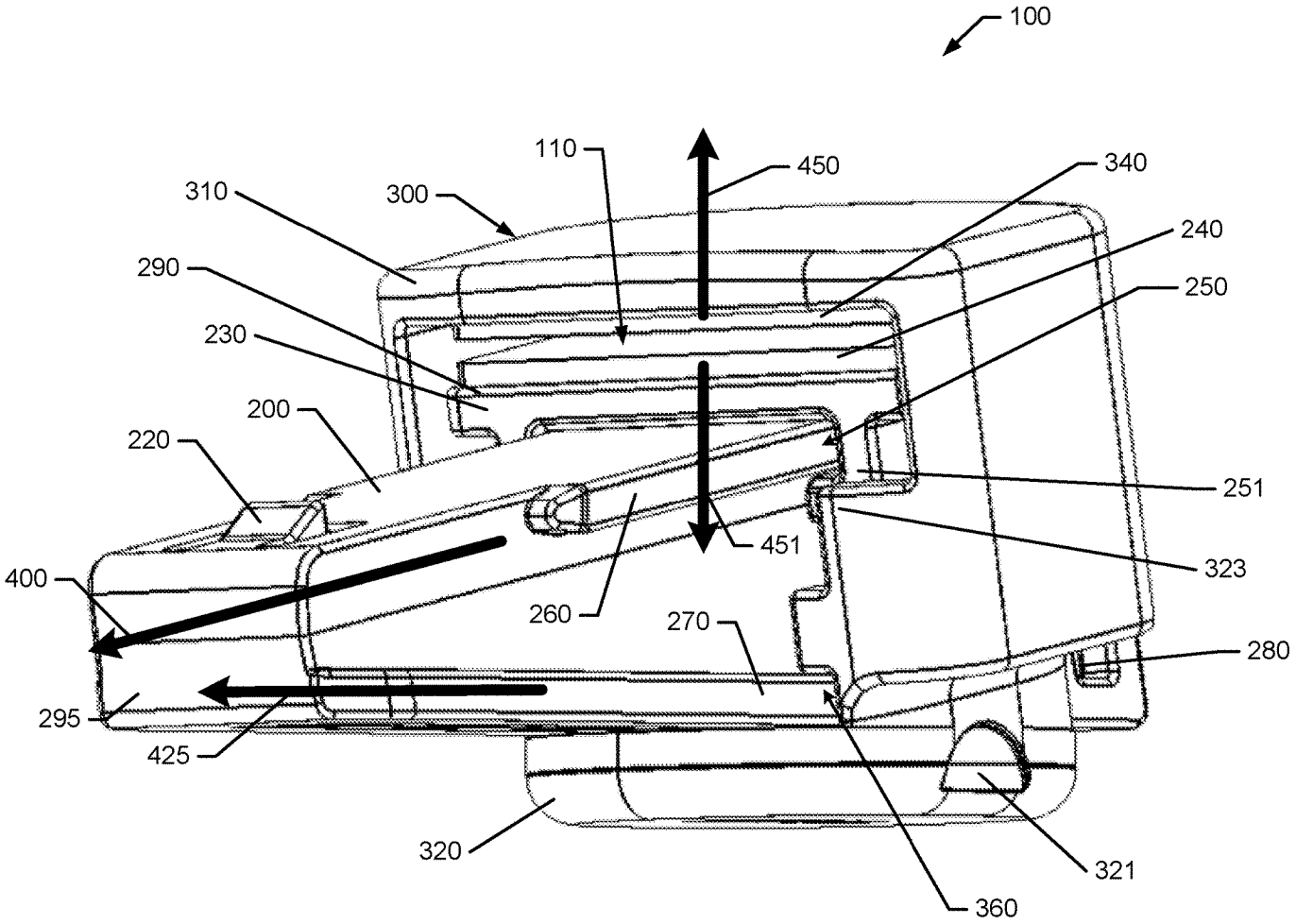
Figure 3:
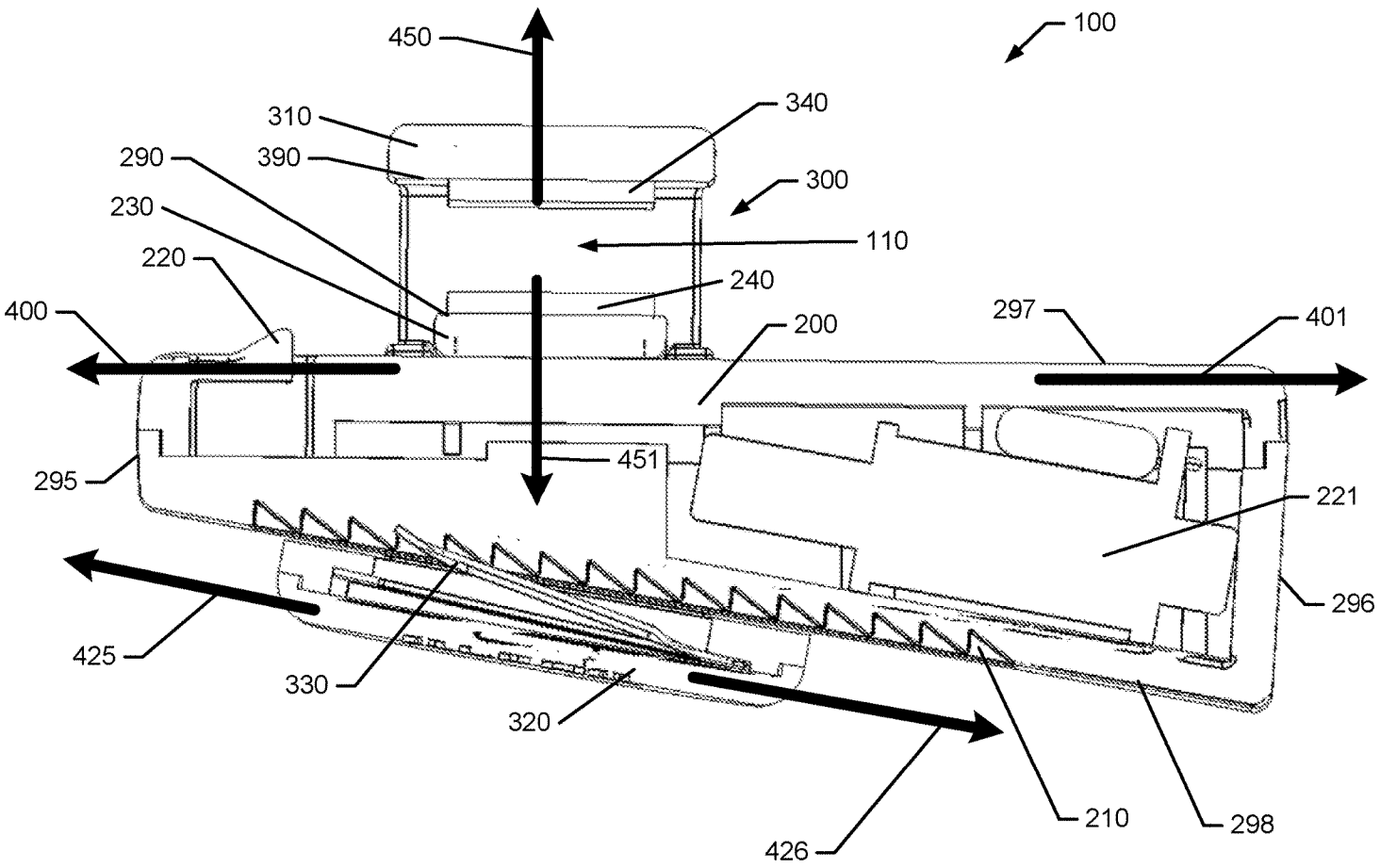
Figure 4:
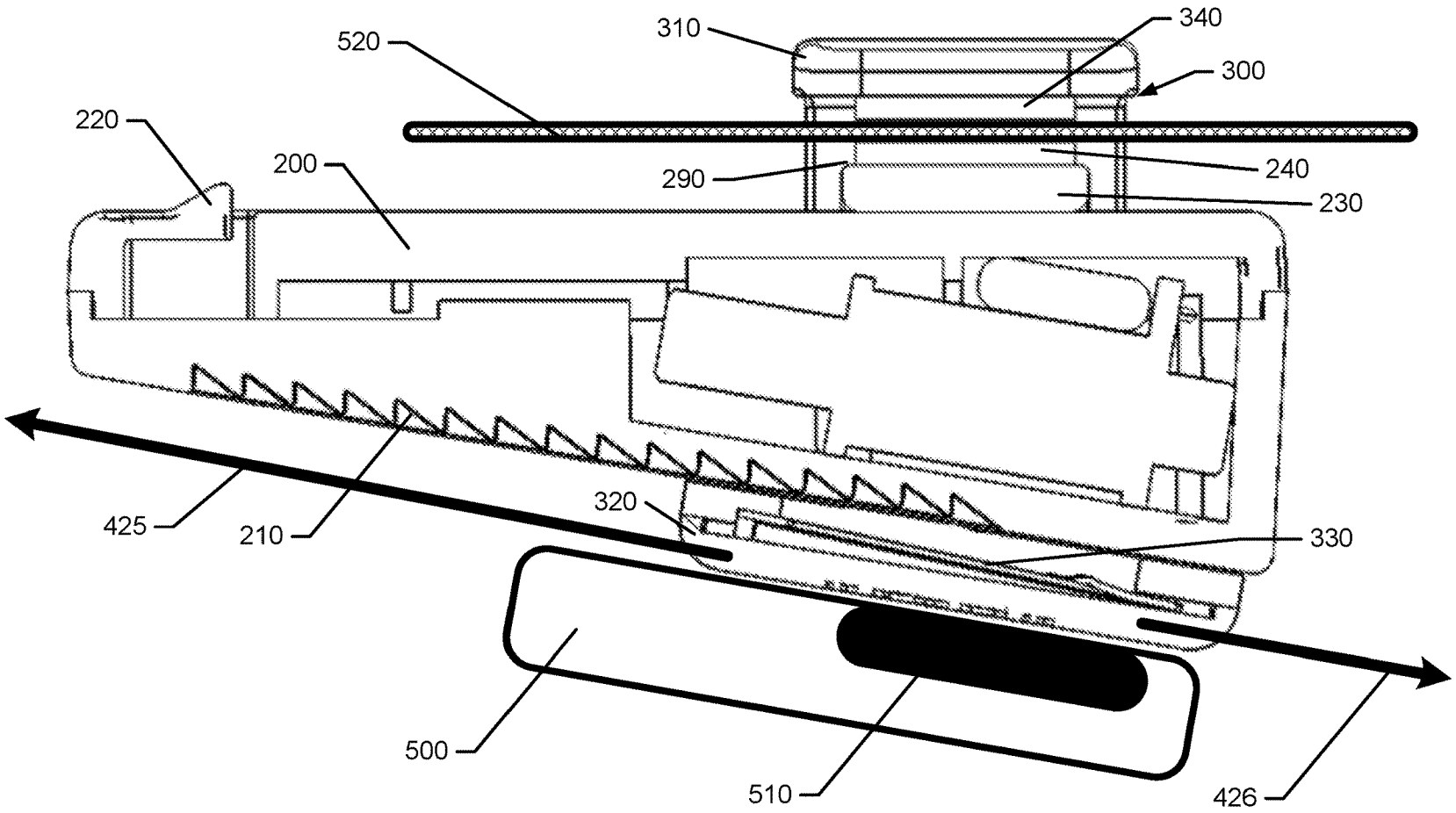
Figure 5:
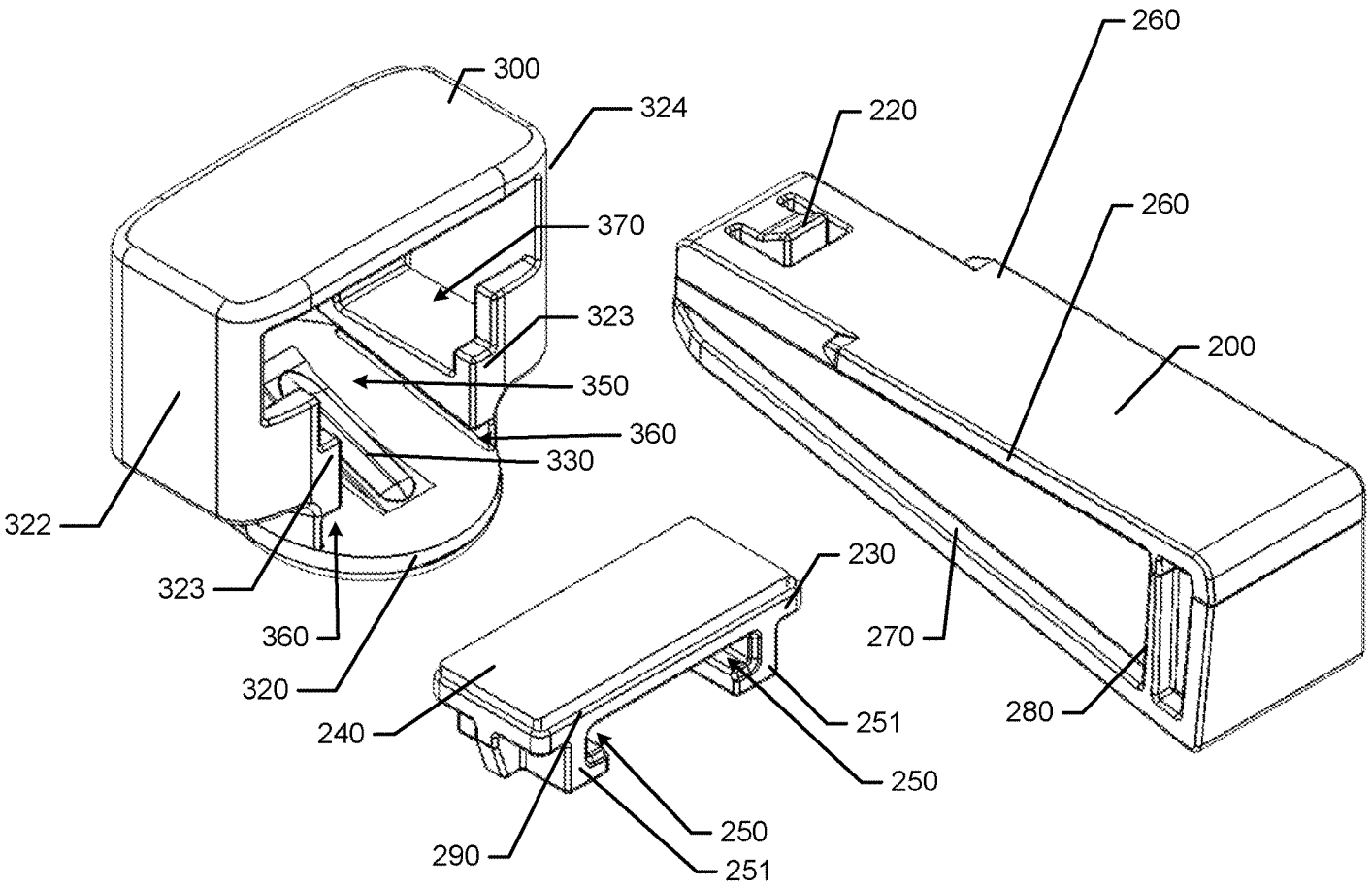

Having thus described the adjustable clamp security device in general terms, reference will now be made to the accompanying drawings, which are not necessarily drawn to scale, and wherein:

FIG. 1 illustrates a cross-section side view of an example adjustable clamp security device with a shuttle in a rearward position in accordance with an example embodiment;

FIG. 2 illustrates a perspective view of an adjustable clamp security device with a shuttle in a rearward position in accordance with an example embodiment;

FIG. 3 illustrates a cross-section side view of an adjustable clamp security device with a shuttle in a forward position in accordance with an example embodiment;

FIG. 4 illustrates a cross-section side view of an adjustable clamp security device in association with a detacher key and an item in accordance with an example embodiment; and FIG. 5 illustrates the disassembled components of an adjustable clamp security product in accordance with an example embodiment.

DETAILED DESCRIPTION OF SOME EXAMPLE EMBODIMENTS

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. As used herein, operable coupling should be understood to relate to direct or indirect connection that, in either case, enables functional interconnection of components that are operably coupled to each other.

According to various example embodiments, an example adjustable clamp security device is provided that securely attaches to an item via an adjustable clamp and protects an item, such as a retail product, from being stolen. In this regard, the example security device may include a wireless signal transmitting device that can be detected by an antenna at, for example, an exit of a retail establishment to indicate that the item to which the security device is attached is being stolen. The security device may be removable (and reusable) through the use of a prescribed key (e.g., a magnetic key) at a point of sale in a retail establishment during a transaction to purchase the item.

According to some example embodiments, the security device may include an adjustable and lockable clamp that receives a portion of the item in a jaw gap to secure the security device to the item. A user (e.g., retail store personnel) may then operate the example security device in a manner that closes the opposing jaws forming the jaw gap onto the portion of the item and lock the jaws in place on the item such that the security device is secured to the portion of the item. Compression pads affixed to each of the jaws may be included to facilitate secure attachment of the security device to an item. Further, the jaws may be closed in response to a ratcheting action that permits the jaw gap to be further reduced to tighten the jaws onto the item, but prevents the jaw gap from being increased to loosen the security device's hold on the item.

According to some example embodiments, an example security device is provided that comprises a core and a shuttle. The core may have an internal jaw and a guide surface. The core may, according to some example embodiments, be in the shape of a wedge. In this regard, for example, a distance between the internal jaw and the guide surface may vary (e.g., reduce or increase linearly) across a length of the core. The shuttle may include an opening that forms an external jaw and the core may be movably disposed within the opening of the shuttle such that the guide surface of the core engages with the shuttle to permit the shuttle to slide along the guide surface. A jaw gap may be defined between the internal jaw and the external jaw. In this regard, the guide surface may be positioned to guide movement of the shuttle such that as the shuttle moves relative to the core in a sliding direction having a horizontal component, the variation in the distance between internal jaw and the guide surface may cause the jaw gap to change in a vertical direction (e.g., expand or contract) to receive a portion of an item to protect.

In view of the foregoing, FIG. 1 illustrates a cross-section view of an example adjustable clamp security device 100 with a shuttle 300 in a rearward position in accordance with an example embodiment. FIG. 2 illustrates a perspective view of the example adjustable clamp security device 100 with the shuttle 300 in the rearward position in accordance with an example embodiment. FIG. 3 illustrates an cross-section view of an example security device 100 with a shuttle 300 in a forward position in accordance with an example embodiment. Reference will be made to FIGS. 1 through 3 to facilitate explanation of the structure and operation of the example security device 100.

For reference, horizontal directions, sliding directions, and vertical directions are defined for convenience of explanation. The security device 100 may be comprised of a core 200 and a shuttle 300. The core 200 may have a forward portion 295 and a rearward portion 296. The core 200 may also have an upper side 297 and a lower side 298. Note that these relative locational descriptors are merely used for explanation purposes are not intended to state an orientation of operation for the example security device 100. The security device 100 may be utilized in any orientation. In this regard, the horizontal directions may be defined as a forward horizontal direction 400 toward the forward portion 295 of the core 200 and a rearward horizontal direction 401 toward the rearward portion 296 of the core 200. The vertical directions may be defined as an upward direction 450 toward an external jaw 310 of the shuttle 300 and a downward direction 451 toward a lower side 298 of the core 200. The sliding direction 425 may have both horizontal and vertical components as defined by the horizontal directions and the vertical directions. The sliding direction may describe the line upon which the shuttle 300 moves relative to the core 200. The sliding direction may be defined as a forward sliding direction 425 toward the forward portion 295 of the core 200 and a rearward sliding direction 426 toward the rearward portion 296 of the core 200. Based on these defined directions, the core 200 may, according to some example embodiments, be a central component that is disposed within an opening 350 of the shuttle 300 and upon which the shuttle 300 slides in the forward sliding direction 425 or the rearward sliding direction 426 to change a vertical size of the jaw gap 110 through relative vertical movement of the external jaw 310 with respect to the internal jaw 230 in the upward direction 450 or the downward direction 451, while the internal jaw moves in a forward horizontal direction 400 or a rearward horizontal direction 401 with the shuttle 300.

The core 200 may include a guide surface 270 upon which the shuttle 300 interfaces to facilitate relative sliding of the shuttle 300 in the sliding directions 425, 426. As seen in FIG. 2, the guide surface 270 may be an engagement lip disposed along a side of the core 200 that is received in a recess 360 of the shuttle 300 to facilitate sliding of the shuttle 300. As the shuttle 300 slides, for example, in the forward sliding direction 425, the shuttle 300 may be stopped by forward stop 220, which may be a flexible protrusion that is ramped to facilitate assembly of the security device 100 and operates to prevent the shuttle 300 from sliding off of the core 200 and being separated from the core 200 after assembly. Likewise, a rearward stop 280 may be formed to prevent movement of the shuttle 300 in the rearward sliding direction 426, once the shuttle 300 has reached a rearmost position.

According to some example embodiments, an internal jaw that may be used to define the jaw gap 110 may simply be the upper surface 297 of the core 200. However, to facilitate improved engagement with an item, an internal jaw sliding member 230 may alternatively be used, which may include the internal jaw 290. The internal jaw sliding member 230 may be a component of the core 200. However, the internal jaw sliding member 230 may slide relative to the core 200 in the horizontal directions 400, 401 as the shuttle 300 slides in the sliding directions 425, 426, respectively. The internal jaw sliding member 230 may slide in the horizontal directions 400, 401 along the internal jaw guide surface 260, which may be a lip that is engaged by the internal jaw sliding member 230 via the recessed areas 250 formed by arms 251. The internal jaw sliding member 230 may be constrained within a cavity 370 of the shuttle 300 such that the internal jaw sliding member 230 moves with the shuttle 300 in the horizontal directions 400, 401, but moves relative to the shuttle 300 in the vertical directions 450, 451. In this regard, the internal jaw sliding member 230 may include arms 251 that contact shoulders 323 of the shuttle 300 when the shuttle 300 is sliding to maintain constrained horizontal movement of the internal jaw sliding member 230 with the shuttle 300. However, due to the angular relationship between the guide surface 270 and the internal jaw guide surface 260, as the shuttle 300 moves in sliding directions 425, 426, the internal jaw sliding member 230 may slide vertically against the shoulders 323 to move the internal jaw sliding member 230 in the vertical directions 450, 451, respectively, thereby closing or opening the jaw gap 110.

In this regard, as shown in FIGS. 1 and 2, the shuttle 300 is positioned in a rearward position where a distance between the internal jaw 290 and guide surface 270 is relatively large, and thus the jaw gap 110 is relatively small because the external jaw 310 is in a vertically low relative position. However, in FIG. 3, the shuttle 300 has been slid into a forward position. In this forward position, the distance between the internal jaw 290 and guide surface 270 is relatively small, and thus the jaw gap 110 is relatively large because the external jaw 310 is in a vertically high relative position. As such, in view of the above, the guide surface 270 may be positioned to guide movement of the shuttle 300 such that the shuttle 300 moves relative to the core 200 in a sliding direction 425, 426 that includes a horizontal component. Further, a variation in the distance between internal jaw 290 and the guide surface 270 may cause the jaw gap 110 to change in a vertical direction 450, 451.

Having described the movement of the components of the security device 100, a ratcheting assembly may now be described with reference to FIGS. 1, 3, and 4 for locking the shuttle 300 into a selected position relative to the core 200. In this regard, the ratcheting assembly may be configured to permit sliding of the shuttle 300 in the rearward sliding direction 426 to close the jaw gap 110 and tighten the security device 100 onto an item, but prevent sliding of the shuttle 300 in the forward sliding direction 425 to prevent opening of the jaw gap 110 and removal of the item to be protected.

In this regard, referring to FIGS. 1 and 3, the ratchet assembly may include a spring biased member 330 and ratcheting teeth 210. The spring biased member 330 may be any member that is elastic in a manner that the member may tend to revert back into an original position after being deflected. The spring biased member 330 may be affixed to and be a component of the shuttle 300 and the ratcheting teeth may be disposed on lower side 298 of the core 200. According to some example embodiments, the ratcheting teeth may be angled relative to the spring biased member 330 in a manner that permits the spring biased member 330 and the shuttle 300 to move freely in the rearward sliding direction 426 thereby closing the jaw gap 110, but causes the spring biased member 330 to catch and prevent movement of the shuttle 300 in the forward sliding direction 425 that would increase the jaw gap 110, when the spring biased member 330 is in an extended position.

With reference to FIG. 4, according to some example embodiments, the spring biased member 330 may be a leaf spring. The spring biased member 330 may be comprised of a ferrous material that is attracted to a magnet and therefore deforms (e.g., becomes compressed) when subjected to a magnetic field. In this regard, as shown in FIG. 4, when the spring biased member 330 is subjected to a magnetic field created by magnet 510 of detacher key 500, the spring biased member 330 may deform or compress in the direction of the magnet 510 and move out of engagement with the ratcheting teeth 210. With the spring biased member 330 compressed into a downward position and out of engagement with the ratcheting teeth 210, the shuttle 300 may be free to move in both the forward sliding direction 425 and the rearward sliding direction 426 without being inhibited by the spring biased member 330. Accordingly, by disengaging the spring biased member 330, the detacher key 500 permits the shuttle 300 to be slid in the forward sliding direction 425, which increases the jaw gap 110 and permit removal of the item 520 (e.g., an eye glasses arm). According to some example embodiments, a key locator detent 321 as shown in FIG. 2 may be provided to assist a user with placement of the detacher key 500 relative to the security device 100. Together, the security device 100 and the detacher key 500 may form an example system, according to some example embodiments.

To apply the security device 100 to an item (i.e., in the absence of the detacher key 500), the security device 100 may initially be configured with the shuttle 300 in a forward position to permit insertion of an item into the jaw gap 110, since the jaw gap 110 will be relatively large with the shuttle 300 in a forward position. With the item inserted into the jaw gap 110, the shuttle 300 may be slid in the rearward sliding direction 426 to thereby reduce the size of the jaw gap 110 and clamp onto the item.

As mentioned above, the exterior jaw surface 390 and the internal jaw 290 may have compression pads 340, 240 affixed their respective engaging surfaces. The compression pads 240, 340 may operate to both provide additional grip onto the item via a higher coefficient of friction and increase the surface area of contact by permitting the item to depress into the compression pads 240, 340. Also, because the compression pads 240, 340 may have a soft surface, the compression pads 240, 340 may also protect the item from being scratched or from other damage that may occur due to clamping the security device 100 onto the item.

As the shuttle 300 moves in the rearward sliding direction 426, the jaw gap 110 closes, but also the spring biased member 330 repeatedly engages a next ratchet tooth 210. In doing so, the spring biased member 330 and the ratchet teeth 210 operate to lock the jaw gap 110 into an increasing smaller size thereby ultimately locking the security device 100 onto the item when a sufficient amount of force is applied to the shuttle 300 to move the shuttle 300 in the rearward sliding direction 426. As such, the adjustability of the security device 100 for use with different items may be realized.

The example security device 100 may also incorporate wireless communications technology for loss prevention and inventory tracking purposes. According to some example embodiments, the core 200 may include an interior cavity that houses a security element 221 that is configured to transmit wireless signals. The security element 221 may be a radio frequency resonator, an acousto-magnetic resonator, or an RFID tag. In this regard, as a radio frequency resonator or acousto-magnetic device, the security element 221 may resonate in the presence of a electromagnetic field of a certain frequency and return a resonance signal that may be detected. In response to detecting the return resonance signal from the security element 221, a remote alarm may be triggered to indicate that, for example, an individual is attempting to exit a retail establishment without having first had the security device 100 removed from an item for sale, which may be indicative of an attempted theft of the item.

Additionally or alternatively, the security element 221 may include an RFID tag. In this regard, the RFID tag may be configured to respond to an interrogation signal with a unique code indicative of the RFID tag. As such, the RFID tag may facilitate not only theft deterrence functions, but also inventory counting or tracking of the location of the security device 100 within and environment that is appropriately equipped with tracking hardware.

Having described the structure and operation of the security device 100 in an assembled configuration, reference is now directed to FIG. 5 which shows disassembled components of the security device 100 to provide additional clarity of understanding. In this regard, FIG. 5 shows the core 200, the internal jaw sliding member 230, and the shuttle 300. As mentioned above, the core 200 may comprise the guide surface 270 and the internal jaw guide surfaces 260. Since the internal jaw sliding member 230 may move along the internal jaw guide surface 260, the distance between the internal jaw 290 and the guide surface 270 may vary (e.g., linearly) along a length of the core 200. Further, forward stop 220 and rearward stop 280 may also be included on core 200.

With respect to shuttle 300, the internal features can be more clearly viewed in FIG. 5. In this regard, the opening 350 that receives the body of the core 200 is shown, where the opening 350 may form the external jaw 310. In this regard, the opening 350 may be formed by the external jaw 310, side walls 322, 324, and lower shuttle portion 320 as a continuous exterior. The lower shuttle portion 320 may house the spring biased member 330 and may have a surface that is angled based on the sliding directions 425, 426. Further, the shuttle 300 may include cavity 370 for receiving the internal jaw sliding member 230 and shoulders 323 for retaining the internal jaw sliding member 230 within the shuttle 300. The shuttle 300 also includes recesses 360 for interfacing with guide surface 270 of the core 200.

The internal jaw sliding member 230 is also shown in isolation. According to some example embodiments, the internal jaw sliding member 230 may be a separate component of the core 200. The internal jaw sliding member 230 may include the internal jaw 290 and the affixed compression pad 240. Further, internal jaw sliding member 230 may include recesses 250 for engagement with the internal jaw guide surface 260 of the core 200, and formed by arms 251 which may abut shoulders 323 of the shuttle 300 as described above.

Many modifications and other embodiments set forth herein will come to mind to one skilled in the art to which these inventions pertain having the benefit of the teachings presented in the foregoing descriptions and the associated drawings. Therefore, it is to be understood that embodiments are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

What is claimed is:

1. A security device comprising:

a core comprising an internal jaw and a guide surface, wherein a distance between the internal jaw and the guide surface varies across a length of the core; the core further comprising an internal jaw guide surface and an internal jaw sliding member that engages the internal jaw guide surface, wherein the internal jaw is disposed on the internal jaw sliding member, and wherein the internal jaw sliding member moves horizontally with the shuttle; and a shuttle comprising an opening that forms an external jaw;

wherein the core is movably disposed within the opening of the shuttle such that the guide surface engages with the shuttle;

wherein a jaw gap is defined between the internal jaw and the external jaw; and wherein the guide surface is positioned to guide movement of the shuttle such that as the shuttle moves relative to the core in a sliding direction that includes a horizontal component, the variation in the distance between internal jaw and the guide surface causes the jaw gap to change in a vertical direction;

wherein the jaw gap is configured to receive a portion of an item to protect.

2. The security device of claim 1, wherein the internal jaw sliding member is disposed within a cavity of the shuttle.

3. The security device of claim 1, wherein the core further comprises ratcheting teeth and the shuttle further comprises a spring biased member configured to engage the ratcheting teeth.

4. The security device of claim 3, wherein the ratcheting teeth and the spring biased member are configured to permit movement of the shuttle relative to the core in a first sliding direction and prevent movement of the shuttle relative to the core in a second sliding direction when the spring biased member is in an extended position.

5. The security device of claim 4, wherein the spring biased member is configured to be compressed and moved out of engagement with the ratcheting teeth in response to a magnetic field.

6. The security device of claim 1, wherein the distance between the internal jaw and the guide surface reduces linearly across the length of the core.

7. The security device of claim 1, wherein the distance between the internal jaw and the guide surface reduces linearly across the length of the core such that as the shuttle moves in a sliding direction where the distance between the internal jaw and the guide surface reduces, the jaw grip increases.

8. The security device of claim 1, further comprising a security element configured to transmit wireless signals; wherein the security element comprises an RFID tag, a radio frequency resonator, or an acousto-magnetic resonator.

9. The security device of claim 1, wherein the guide surface is an engagement lip disposed along a side of the core and wherein the shuttle includes a recess for receiving the engagement lip.

10. The security device of claim 1, wherein the core further comprises a protruding stop configured to prevent the shuttle from being separated from the core.

11. The security device of claim 1, wherein the shuttle includes a compressible pad affixed to an engagement surface of the external jaw.

12. The security device of claim 1, wherein the internal jaw sliding member further comprises a compressible pad affixed to the internal jaw.

13. The security device of claim 1, wherein the core further comprises ratcheting teeth and the shuttle further comprises a spring biased member configured to engage the ratcheting teeth, wherein the spring biased member comprises a leaf spring.

14. The security device of claim 1, wherein the core further comprises ratcheting teeth and the shuttle further comprises a spring biased member configured to engage the ratcheting teeth, wherein the spring biased member is configured to be compressed and moved out of engagement from the ratcheting teeth in response to a magnetic field thereby allowing the shuttle to slide freely in a forward sliding direction and in a rearward sliding direction, wherein a detacher key provides the magnetic field.

15. A system comprising:

a detacher key comprising a magnet; and a security device comprising:

a core comprising an internal jaw and a guide surface, wherein a distance between the internal jaw and the guide surface varies across a length of the core; and a shuttle comprising an opening that forms an external jaw;

wherein the core is movably disposed within the opening of the shuttle such that the guide surface engages with the shuttle;

wherein a jaw gap is defined between the internal jaw and the external jaw; and wherein the guide surface is positioned to guide movement of the shuttle such that as the shuttle moves relative to the core in a sliding direction having a horizontal component, the variation in the distance between internal jaw and the guide surface causes the jaw gap to change in a vertical direction;

wherein the jaw gap is configured to receive a portion of an item to protect;

wherein the core further comprises ratcheting teeth and the shuttle further comprises a spring biased member configured to engage the ratcheting teeth;

wherein the spring biased member is configured to be compressed and moved out of engagement from the ratcheting teeth in response to a magnetic field thereby allowing the shuttle to slide freely in a forward sliding direction and a rearward sliding direction;

wherein the magnet of the detacher key provides the magnetic field.

16. A security device comprising:

a core comprising an internal jaw and a guide surface, wherein a distance between the internal jaw and the guide surface varies across a length of the core; and a shuttle comprising an opening that forms an external jaw;

wherein the core is movably disposed within the opening of the shuttle such that the guide surface engages with the shuttle;

wherein a jaw gap is defined between the internal jaw and the external jaw; and wherein the guide surface is positioned to guide movement of the shuttle such that as the shuttle moves relative to the core in a sliding direction that includes a horizontal component, the variation in the distance between internal jaw and the guide surface causes the jaw gap to change in a vertical direction;

wherein the jaw gap is configured to receive a portion of an item to protect; and wherein the core comprises ratcheting teeth and the shuttle comprises a spring biased member configured to engage the ratcheting teeth.

17. The security device of claim 16, wherein the spring biased member comprises a leaf spring.

18. The security device of claim 16, wherein the spring biased member is configured to be compressed and moved out of engagement from the ratcheting teeth in response to a magnetic field thereby allowing the shuttle to slide freely in a forward sliding direction and in a rearward sliding direction, wherein a detacher key provides the magnetic field.

* * * * *